US007049502B2

(12) United States Patent
Taku et al.

(10) Patent No.: US 7,049,502 B2
(45) Date of Patent: May 23, 2006

(54) MUSIC TUNER

(75) Inventors: Takeo Taku, Tokyo (JP); Kousuke Higo, Tokyo (JP)

(73) Assignee: Korg, Inc, Tokyo (JP)

( * ) Notice: Subject to any disclaimer, the term of this patent is extended or adjusted under 35 U.S.C. 154(b) by 181 days.

(21) Appl. No.: 10/692,489

(22) Filed: Oct. 24, 2003

(65) Prior Publication Data

US 2005/0087060 A1 Apr. 28, 2005

(51) Int. Cl.
*G10G 7/02* (2006.01)

(52) U.S. Cl. ..... 84/454; 84/DIG. 18

(58) Field of Classification Search ..... 84/200, 84/454–455, DIG. 18
See application file for complete search history.

(56) References Cited

U.S. PATENT DOCUMENTS

| | | | | |
|---|---|---|---|---|
| 4,245,540 | A * | 1/1981 | Groupp | 84/726 |
| 4,429,609 | A | 2/1984 | Warrender | |
| 4,899,636 | A | 2/1990 | Chiba et al. | |
| 5,009,142 | A | 4/1991 | Kurtz | |
| 5,723,804 | A * | 3/1998 | Replogle | 84/726 |
| 5,777,248 | A | 7/1998 | Campbell | |
| 5,936,179 | A | 8/1999 | Merrick et al. | |
| 5,990,403 | A | 11/1999 | Membreno et al. | |
| 6,278,047 | B1 | 8/2001 | Cumberland | |
| 6,291,755 | B1 | 9/2001 | Hine et al. | |
| 6,437,226 | B1 | 8/2002 | Oudshoorn et al. | |
| 6,580,024 | B1 * | 6/2003 | Skubic | 84/477 R |
| 6,806,411 | B1 * | 10/2004 | Allen | 84/454 |
| 6,894,212 | B1 * | 5/2005 | Capano | 84/454 |
| 2003/0140767 | A1 * | 7/2003 | Yagi | 84/454 |
| 2004/0144235 | A1 * | 7/2004 | Taku | 84/454 |
| 2004/0182224 | A1 * | 9/2004 | Catalano et al. | 84/454 |

* cited by examiner

*Primary Examiner*—Marlon T. Fletcher
(74) *Attorney, Agent, or Firm*—Muramatsu & Associates

(57) ABSTRACT

A music tuner having both a contact sensing device and a non-contact sensing device to pick up the sound from a music instrument is so designed that it can automatically or manually select one of the sensing devices that is most suitable to the situation where the music tuner is used. The display screen of the music tuner is freely rotatable and pivotable, thereby allowing optimum view angle wherever the music tuner is placed. The display screen is configured to graphically represent the tune of the music instrument so that the user can easily and intuitively grasp the pitch of the sound as compared with a standard pitch. The music tuner is able to display the result by a normal display mode, a mirror display mode, or a combination of both modes.

16 Claims, 16 Drawing Sheets

Power On
201
Select Piezo
202
Piezo output level >Ldb
203
No
Yes
Stop PiezzoOffTimer
204
PiezoOffTimer Running?
206
Yes
No
PiezoOffTimer ← 0sec
Start PiezoOffTimer
207
Piezo Output Select?
208
No
Yes
PiezoOffTimer > Tsec
209
No
Yes
Select Piezo output
205
Select Mic output
210
Data sample Tuning Prog
211
Display Note & Pitch Error
212

Fig. 12A(1)
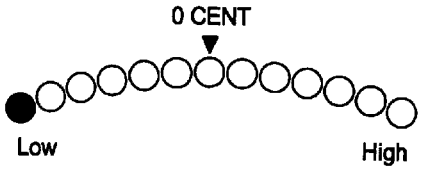
Fig. 12A(2)
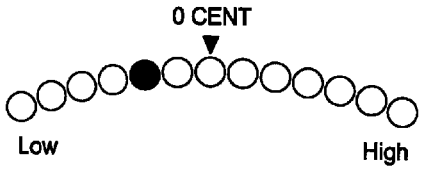
Fig. 12A(3)
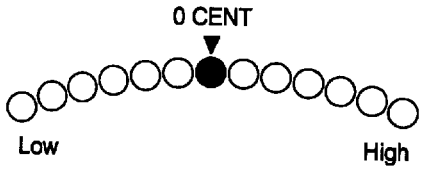
Fig. 12A(4)
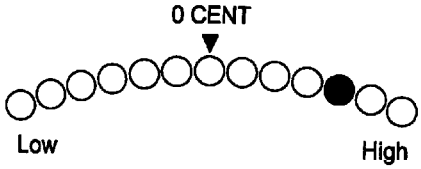
Fig. 12B(1)
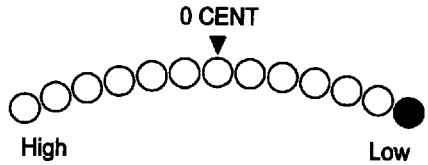
Fig. 12B(2)
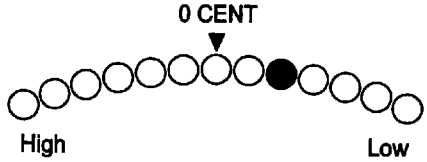
Fig. 12B(3)
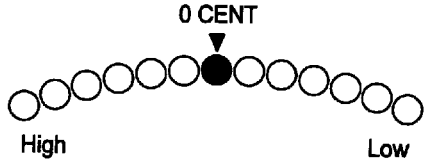
Fig. 12B(4)
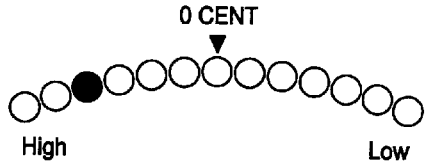

Fig. 13A(1)
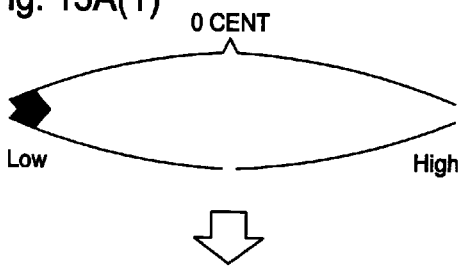
Fig. 13B(1)
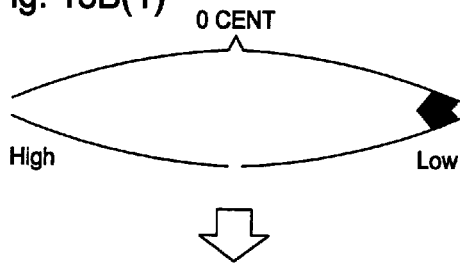
Fig. 13A(2)
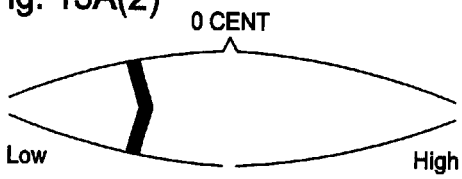
Fig. 13B(2)
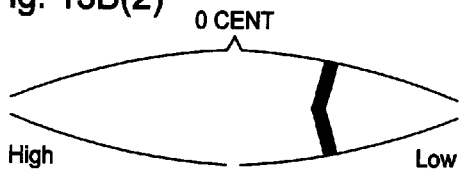
Fig. 13A(3)
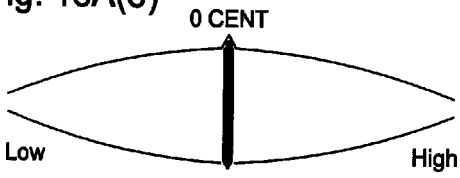
Fig. 13B(3)
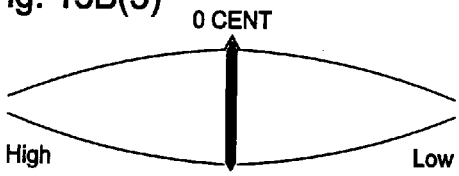
Fig. 13A(4)
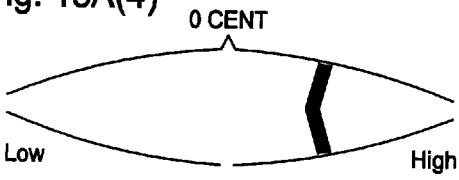
Fig. 13B(4)
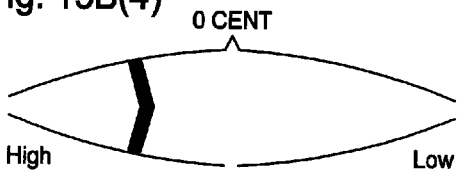

MUSIC TUNER

FIELD OF THE INVENTION

This invention relates to a music tuner to tune music instruments. More particularly, this invention relates to a music tuner to tune music instruments which is able to automatically select a suitable sensing device from either a non-contact sensing device or a contact sensing device to pick-up sounds to be tuned and allows the user to easily see the display of the tuner regardless of a manner that the music tuner is attached to a music instrument, etc.

BACKGROUND OF THE INVENTION

A tuning device for music instrument (hereafter "music tuner") is widely used to measure and adjust the pitch of a sound of a music instrument. Basically, a music tuner measures a frequency of a musical sound to allow the user to adjust the sound to a predetermined frequency.

There are primarily two kinds of music tuners widely available in the market in terms of the type of music sound sensing device. One type of the music tuner has a non-contact sensing device, such as a microphone for picking-up the musical sound in a non-contact manner. Another type of music tuner has a contact sensing device such as a piezo-electric device for picking-up the musical sound by physically contacting with the music instrument. As is well known in the art, the piezoelectric device generates an electric signal (voltage) in response to a mechanical stress (vibration) received from the music instrument.

Ordinarily, the music tuner with a non-contact sensing device (hereafter also referred to as "microphone") is not physically attached to a music instrument. The microphone picks the sound coming from the instrument through the air so that the music tuner can determine the pitch of the sound. The music tuner with a contact sensing device (hereafter also referred to as "piezo device") is physically attached to a music instrument. The piezo device picks the vibration of the music instrument and converts the vibration to a voltage to determine the pitch of the instrument.

Each type of the music tuner having either a microphone or a piezo device has both advantages and disadvantages. In the music tuner using a piezo device, the user can use the music tuner in a relatively noisy environment. For example, when the user is tuning the instrument in an ensemble, several other players are normally present and playing their music instruments. The sounds from other instruments can diminish the accuracy of the music tuner utilizing a microphone because the microphone of the turner can pick the ambient sounds as well. Such a problem will not occur if the music tuner employs a piezo device.

In the music tuner using a microphone, the user need not directly attach the music tuner to the music instrument. Depending on a type of musical instrument, attaching the music tuner so that a sensing device can detect the sound of the instrument may be difficult or impractical. The user may want to leave the music tuner on a music stand so that she can check the pitch any time. In some cases, the user just prefers to use the microphone because ambient sound is negligible or attaching the music tuner to the music instrument is cumbersome. Moreover, in a conventional music tuner using a piezo device, it may become difficult to read the display of the music tuner when it is attached to a specific location of the music instrument. In some cases, the user is forced to see the display from the opposite direction such that the display is upside-down as viewed from the user.

Accordingly, there is a need of a new music tuner that is able to take advantages of both types of the music tuner, one having a microphone and the other having a piezo device, and is integrated in a user-friendly manner into a single tuner so that the user can enjoy the benefit of both types of music tuners.

SUMMARY OF THE INVENTION

The present invention has been made to overcome the shortcomings involved in the conventional technology mentioned above, and therefore, it is an object of the present invention to provide a music tuner which has a non-contact sensing device (microphone) and a contact sensing device (piezo device) and automatically selects a suitable sensing device under the circumstances.

It is another object of the present invention to provide a music tuner which is capable of detaching a part having the contact sensing device (piezo device) from the music tuner so that the tuner functions separately and independently from the piezo device.

It is a further object of the present invention to provide a music tuner which is capable of achieving high flexibility by allowing a tuner body having a display to freely pivot and rotate so that the user can see the display with an optimal viewing angle and direction.

It is still another object of the present invention to provided a music tuner which has a mirror display mode in which a music interval relationship is reversed on the display screen to a normal display mode.

It is a further object of the present invention to provide a music tuner which is able to display a combined music pitch which simultaneously shows both a normal display mode display and a mirror display mode such that the indicators move toward the center as the sound from the music instrument comes closer to the target sound.

The music tuner of the present invention for tuning a music instrument is comprised of: a tuner body having a display screen to show a pitch of a sound from the music instrument and a difference from a target sound; a non-contact sensing device that senses sounds from said music instrument through the air; a contact sensing device that senses sounds from the music instrument by physically contacting with the music instrument; and a circuitry to automatically select either the non-contact sensing device or the contact sensing device for processing the sounds from the music instrument by comparing an output level of the sensing device with a predetermined threshold level.

The music tuner of the present invention includes an attachment clip for attaching the music tuner to an object including the music instrument wherein the contact sensing device is mounted on the attachment clip. The non-contact sensing device is mounted on the tuner body. The tuner body is detachably connected to the attachment clip having the contact sensing device, thereby establishing the music tuner having both the non-contact sensing device and the contact sensing device.

The circuitry in the music tuner selects the contact sensing device for picking the sound of the music instrument when an output level of the contact sensing device is larger than the predetermined threshold level. Further, the circuitry determines whether a predetermined time has passed after the output level of the contact sensing device fell below the predetermined threshold level and selects the non-contact sensing device only if the predetermined time has passed.

The tuner body of the music tuner is attached to the attachment clip in a manner rotatable in clockwise and counterclockwise directions, and further, the tuner body is attached to the attachment clip in a manner pivotable in backward and forward directions.

The display screen displays a measured result of the sound from the music instrument either by a normal display mode or a mirror display mode. In the normal display mode, a lower frequency is displayed at a left side of the display screen and a higher frequency is displayed at a right side of the display screen. In the mirror mode, the lower frequency is displayed at the right side of the display screen and the higher frequency is displayed at the left side of the display screen. Further, the display screen is able to display the measured result of the sound from the music instrument by both the normal display mode and the mirror display mode at the same time.

According to the present invention, because the music tuner can automatically select the appropriate sound sensing device, the user need not worry about which sensing device to select. The user merely needs to attach the tuner to the music instrument. Because the tuner body is pivotable and rotatable, the user can enjoy an optimum viewing angle and condition. The mirror display function allows the user to obtain intuitive display image even when the specific circumstance forces the user to attach the tuner that would otherwise show the indicator in a reverse direction, etc.

BRIEF DESCRIPTION OF THE DRAWINGS

FIG. 1A is a front view of the music tuner, and FIG. 1B is a side view of the music tuner, and FIG. 1C is a rear view of the music tuner of the present invention.

FIGS. 12A(1)–12A(4) are diagrams showing the process of tuning the sound of the music instrument in a normal display mode in the music tuner of the present invention, and FIGS. 12B(1)–12B(4) are diagrams showing the process of tuning the sound in a mirror display mode of the music tuner of the present invention.

FIGS. 13A(1)–13A(4) are diagrams showing the process of tuning the sound of the music instrument in a normal display mode in the music tuner of the present invention, and FIGS. 13B(1)–13B(4) are diagrams showing the process of tuning the sound in a mirror display mode of the music tuner of the present invention.

DETAILED DESCRIPTION OF THE INVENTION

The present invention is explained with reference to the accompanied drawings. The music tuner of the present invention incorporates both the contact sensing device, typically a piezo device, and the non-contact sensing device, typically a microphone, to effectively take advantage of the benefits of both types of sensing device while maximizing the display flexibility and minimizing the complexity of use.

In order to increase the usefulness, the music tuner of the present invention automatically selects either the microphone (non-contact sensing device) or the piezo device (contact sensing device). The music tuner of the present invention also includes a switch to manually selects either the microphone or the piezo device by the user. Thus, the user can set either the automatic mode or the manual mode depending on her unique situation.

The music tuner of the present invention has a tuner body which is freely rotatable, thereby allowing optimum view angle wherever the music tuner is placed. Further, the tuner body is detachably attached to an attachment clip, thus, the tuner body can be used separately from the attachment clip. The tuner body includes a display and the microphone while the attachment clip includes the piezo device, allowing various ways of use to match the particular situations of the user. The screen of the display is configured to graphically represent the tune of the music instrument so that the user can easily and intuitively grasp the pitch of the sound as compared with a standard pitch.

Figure 1A:
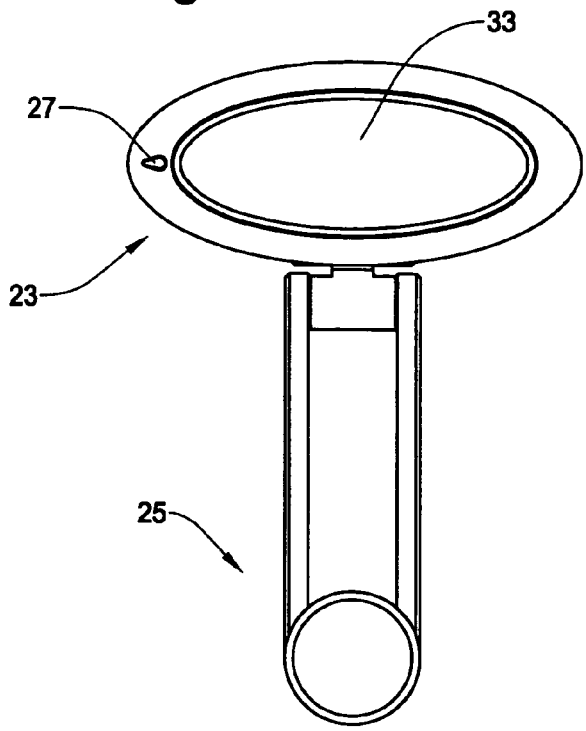
FIGS. 1A–1C are schematic views showing outer appearance of the music tuner of the present invention.
Figure 1B:
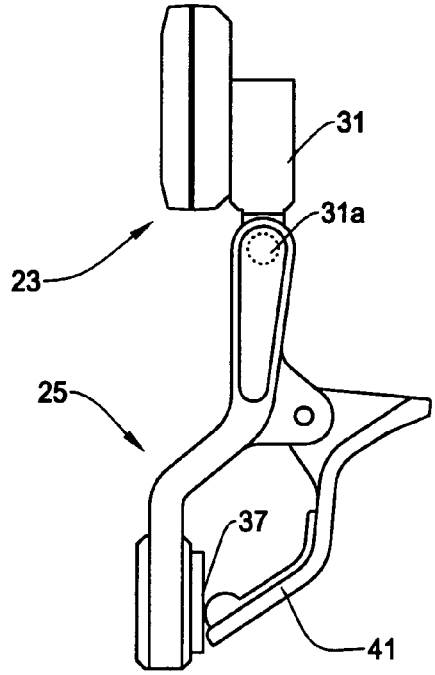
Figure 1C:
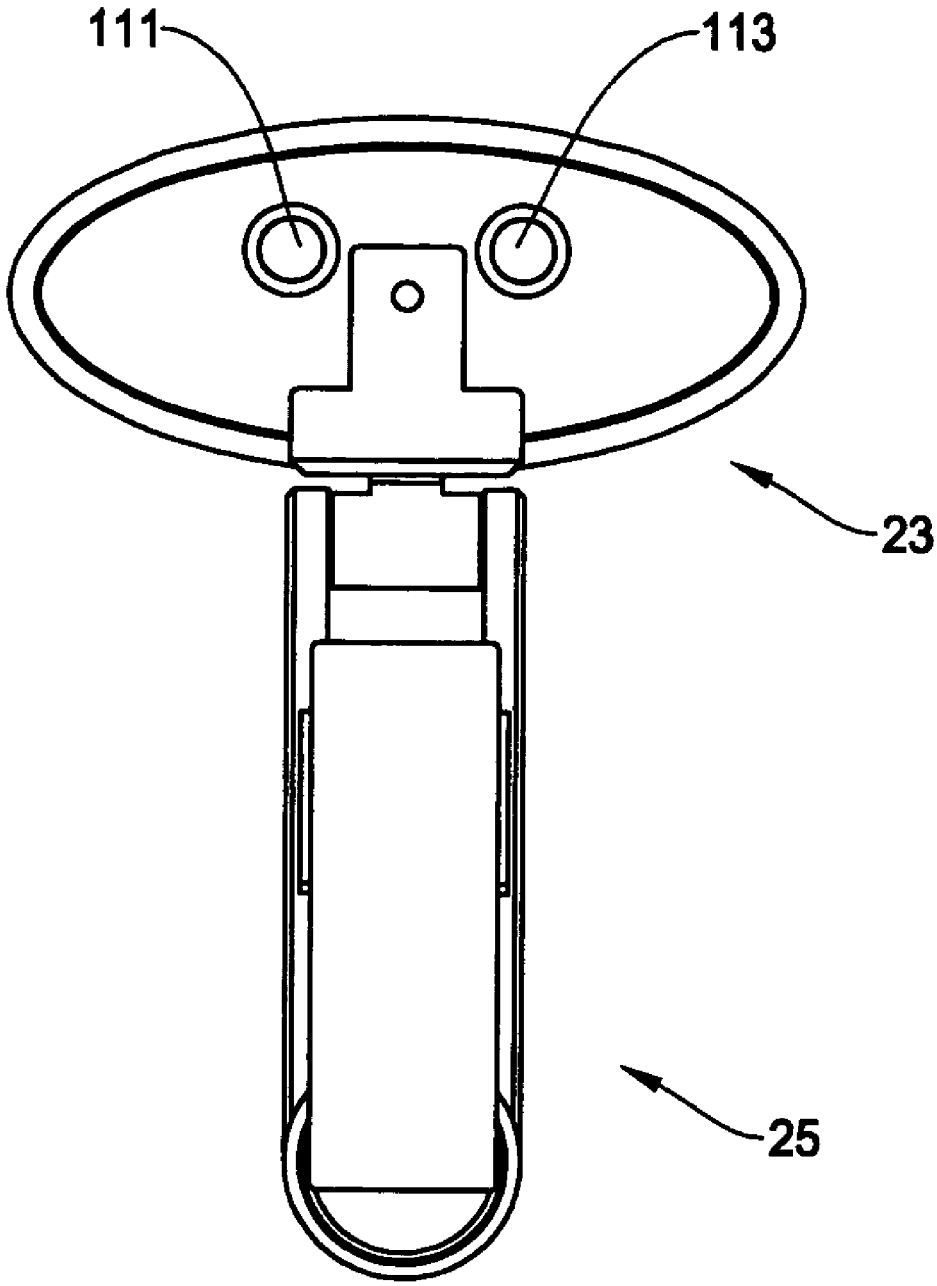

FIGS. 1A–1C schematically show outer appearance of the music tuner of the present invention. FIG. 1A is a front view of the music tuner with a blank display, and FIG. 1B is a side view of the music tuner, and FIG. 1C is a rear view of the music tuner. The music tuner mainly comprises a tuner body 23 having a display screen 33 and a microphone (non-contact sensing device) 27 and an attachment clip 25 having a piezo device (contact sensing device) 37 and a clip end 41. The tuner body 23 is attached to the attachment clip 25 through a hinge portion 31 which is rotatable about a hinge 31*a*. In this example, the display screen 33 has an oval shape although other shapes such as a rectangular shape, circular shape, triangular shape, etc. are also possible. As will be described in detail later, the display screen 33 shows the status of the music tuner and pitches of the music instrument in various ways.

As noted above, the microphone 27 is a non-contact type sensing device to sense the music sound from a music instrument through the air. In the music tuner shown in FIG. 1A, the microphone 27 is located at the front left side of the tuner body 23. However, the microphone 27 can be located at other places as long as it can serve its purpose. The hinge portion 31 is located at the top of the attachment clip 25 and is pivotable about the hinge 31*a* as shown in FIGS. 8A–8B and 9A–9B. The piezo device 37 is provided at the bottom of the attachment clip 25 as a part of clip end so that the music tuner is attached to an music instrument or a music stand, etc, in combination with other clip end 41. The tuner body 23 can be detached from the attachment clip 25 and functions as a microphone tuner as will be explained in more detail later.

As shown in the rear view of FIG. 1C, the tuner body 23 has an auto-on/off switch 111 and a manual switch (piezo-microphone selection switch) 113. Although the auto-on/off switch 111 and the manual switch 113 are provided at the back in this example, these switches can be provided at other locations such as on a front panel, side edges, etc. The manual switch 113 allows the user to manually select the type of input sensing device, i.e., microphone or piezo device, for picking-up the sound of the music instrument. When the auto-on/off switch 111 is set, the music tuner of the present invention automatically selects the appropriate sensing device based on a predetermined algorithm. Although not shown, a power on/off switch may be provided to turn on and off the music tuner.

Figure 2:
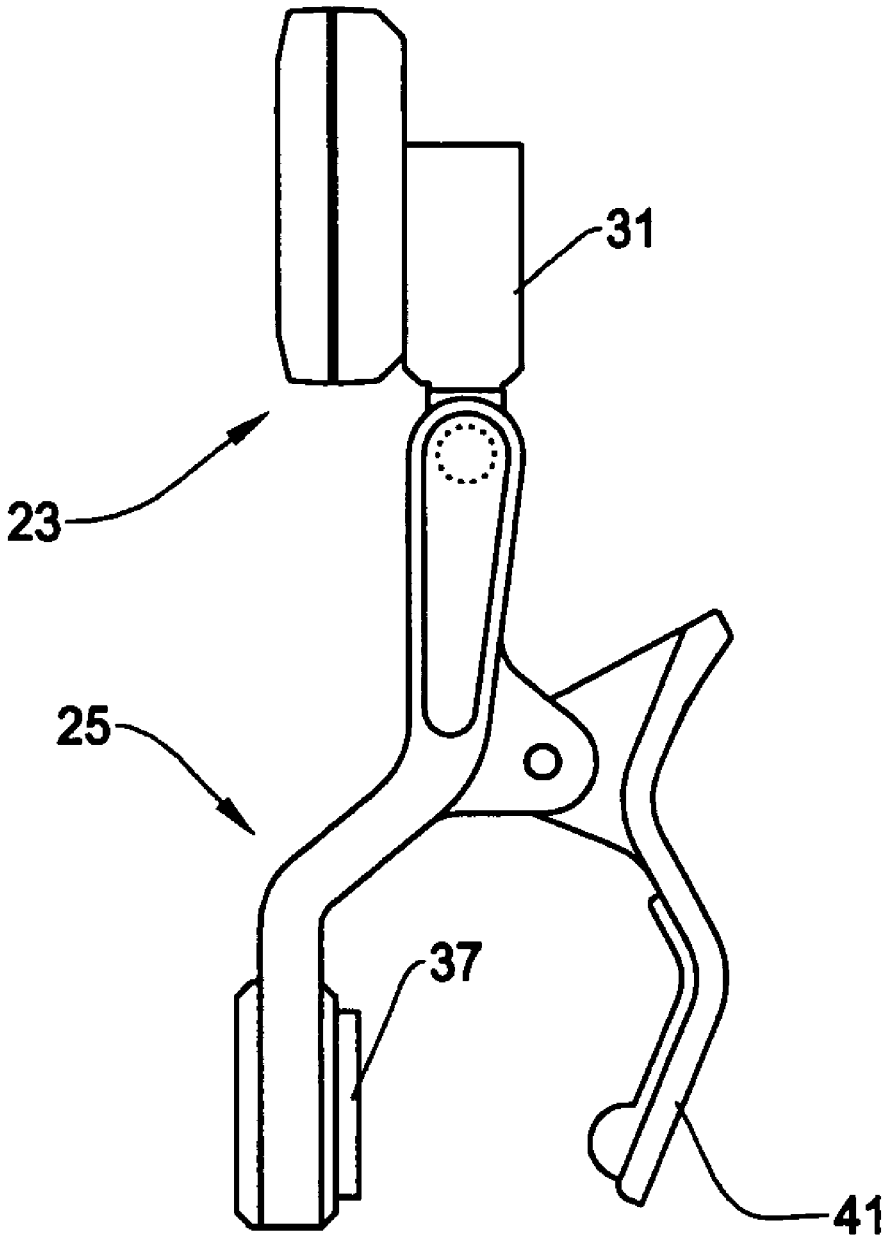
FIG. 2 is a side view of the music tuner of the present invention corresponding to the side view of FIG. 1B where an attachment clip having a piezo device for attachment to a music instrument is opened.

FIG. 2 shows the illustration of the tuner of the present invention where the clip end of the attachment clip 25 opens up to clip onto a music instrument, a music stand, an instrument case, etc. When attached, the piezo device 37 physically contacts with the music instrument to receive the vibration therefrom to detect pitch of the sound from the instrument. When the microphone 27 is used rather than the piezo device 37, the piezo device 37 and the clip end 41 work only as a clamp to attach the music tuner to the music instrument, a music stand, an instrument case, or the like.

When the piezo device 37 is used, the piezo device 37 should be so placed that it can directly touch the music instrument to be tuned. The clip end 41 and the piezo device 37 tightly hold the music instrument to be tuned so as to sufficiently support the music tuner without being slipped or fell off from the music instrument. As is known in the art, the piezo device 37 is made of piezoelectric material such as crystal, ceramic, Rochelle salt, or barium titanate, etc., and converts the vibration from the music instrument to an electric signal.

Figure 3:
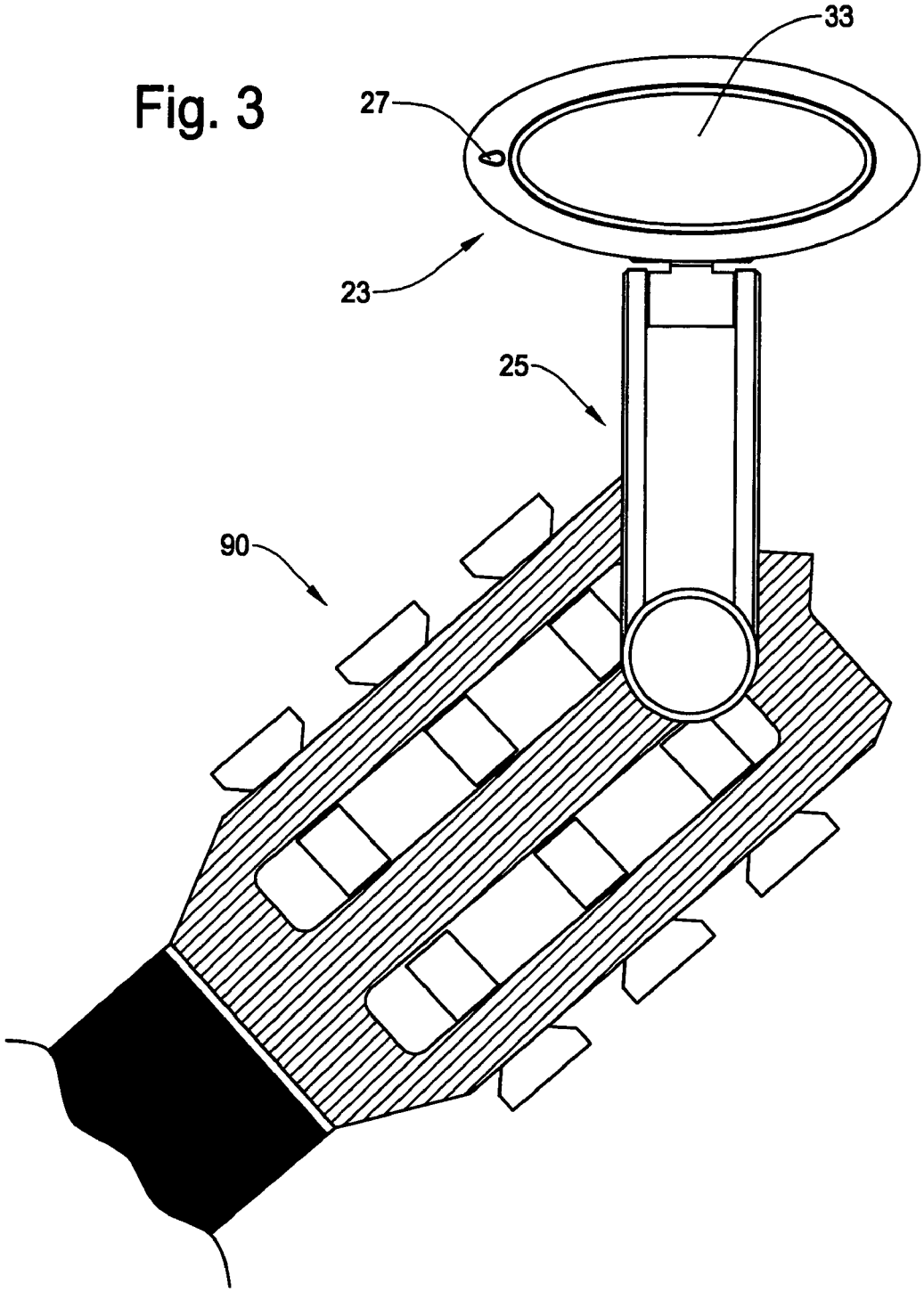
FIG. 3 is an illustration showing the condition where the music tuner of the present invention is attached to a guitar head to pick up the sound from the guitar by the piezo device mounted on an attachment clip.

FIG. 3 illustrates an example of situation where the music tuner of the present invention is attached to a guitar 90, although it can be attached to any other music instruments. As shown in FIG. 3, the music tuner is attached to the guitar head to pick the sound generated by the guitar. In this example, since the guitar head does not produce the vibration, the music tuner will select the microphone (non-contact sensing device) 27 rather than the piezo device 37 to pick-up the sound of the guitar 90.

Figure 4:
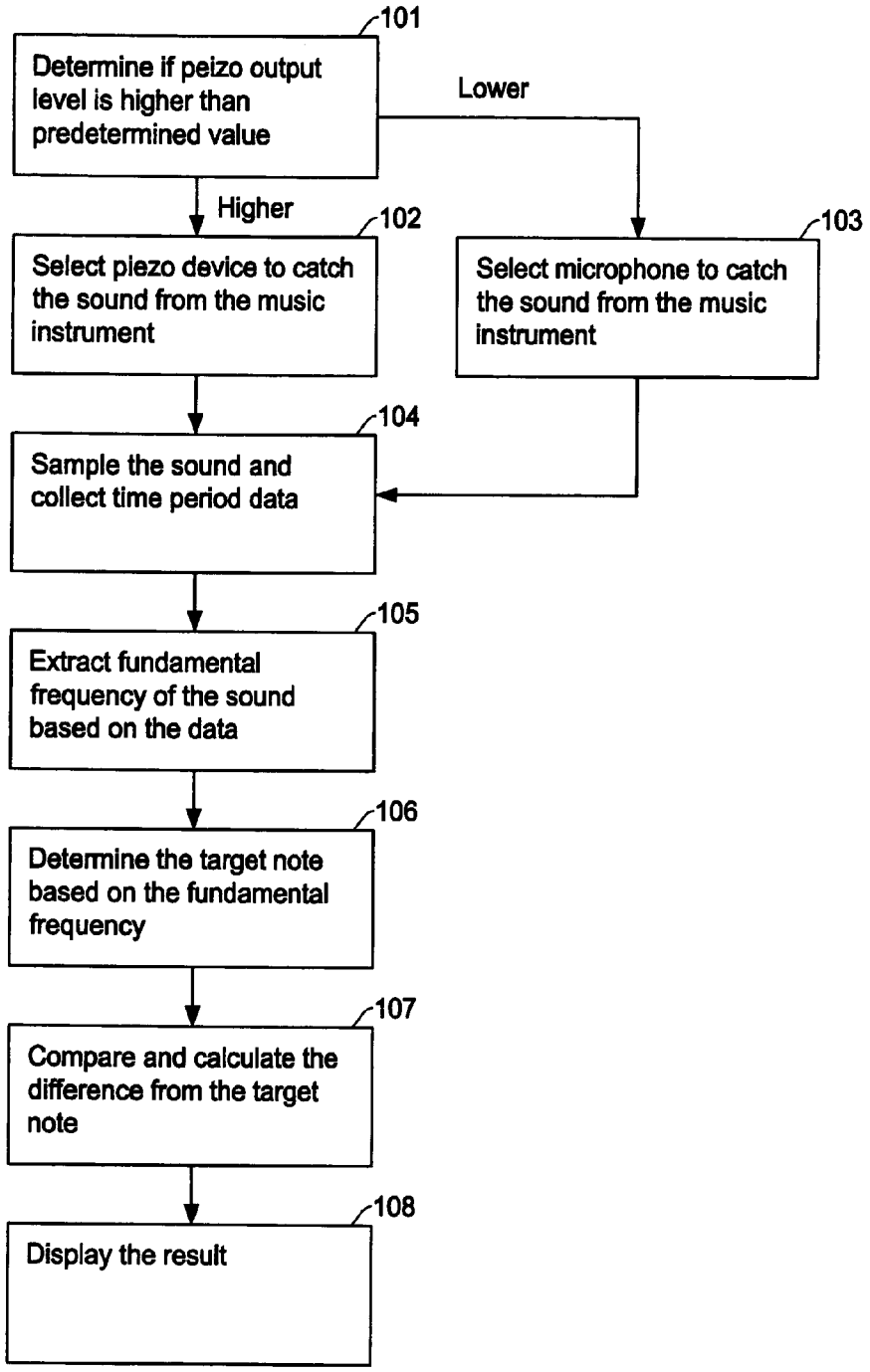
FIG. 4 is a flow chart showing the basic operational flow of the music tuner of the present invention including the steps of selecting a music sound sensing device, either a microphone or a piezo device.

FIG. 4 is a flow chart showing the simplified overall operational flow of the music tuner of the present invention. The more details of this process is explained later with reference to the flow chart of FIG. 6. In FIG. 4, at steps 101–103, the music tuner determines which sensing device should be used. As noted above, one of the essential features of the present invention resides in that the music tuner can automatically select the best suited sensing device to use in a particular condition. It is cumbersome for the user to find a suitable sensing device through a trial-and-error fashion each time the music tuner is to be used. In order to allow the user to concentrate on her music performance and practice, it is desirable that the music tuner senses the ambient atmosphere and determines a suitable sensing device for use in the particular circumstance of the user each time the music tuner is used.

Thus, in an embodiment of the present invention, the music tuner determines the selection between the piezo device 37 (contact sensing device) and the microphone (non-contact sensing device) by evaluating the parameters such as a strength of the signal level from the piezo device. As will be explained later, this configuration allows the user to attach the tuner to anywhere as the user wishes and attain appropriate selection of the sensing device (microphone or piezo device) to pick up the sound of her music instrument.

In the flow chart of FIG. 4, at step 101, the music tuner checks whether the sound level from the piezo device 37 is higher than a predetermined threshold level. For example, the predetermined level is set so that the music tuner can receive electric current of sufficient level to accurately measure the pitch of the music instrument. In a case where an output level from the piezo device is higher than the predetermined level, at step 102, the music tuner selects the output of the piezo device as an input signal to determine the tune of the music instrument. On the other hand, if the output level from the piezo device 37 is lower than the predetermined level, at step 103, the music tuner selects the output of the microphone as an input signal to determine the pitch of the music instrument.

In either case, in step 104, the music tuner samples the input signal (musical sound) so that enough data is accumulated to determine fundamental frequency of the sound. For example, each of the collected data shows a time period of signal component in the input signal (musical sound). In step 105, the music tuner extracts the fundamental frequency of the music sound from the music instrument based on the collected data. This extraction process can be conducted, for example, through a self-correlation process as will be described later.

At step 106, the music tuner determines the target sound (standard note) based on the fundamental frequency extracted in step 105. For example, if the fundamental frequency is closest to G-sound, the music tuner interprets that the user wants to tune the sound to G (target sound). Thus, in step 107, the music tuner compares the acquired fundamental frequency with the target sound, such as G, to determine the difference of the pitch of the instrument from the target sound. Finally, the result is displayed on the screen to show the instrument's sound pitch and its difference from the standard pitch (target sound) in step 108 so that the user can adjust the tune of her music instrument.

In the automatic selection mode, the music tuner selects the microphone (non-contact sensing device) 27 when the tuner body of the present invention is detached from the attachment clip 25 because there will be no signal from the piezo device 37. The user can concentrate on playing a music instrument because the user need not manually switch between the microphone 27 and the piezo device 37. Moreover, because the user need not determine which music sensing device to use in each circumstance, the user does not have to learn as to when it is appropriate to choose a particular sensing device.

Figure 5:
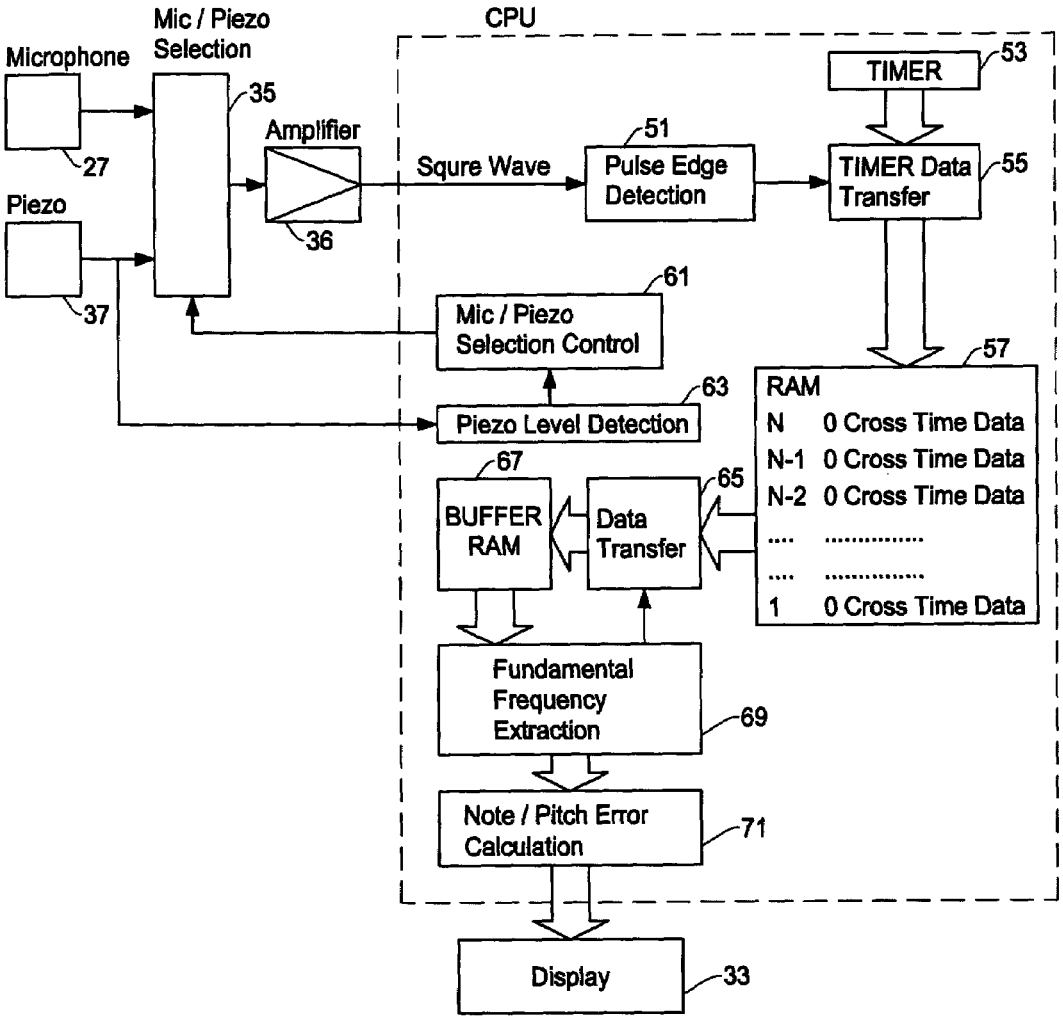
FIG. 5 is a schematic diagram showing the basic configuration of the internal structure of the music tuner of the present invention for automatically selecting a sensing device and measuring the frequency of the sound.

Next, the configuration of the music tuner of the present invention is described with reference to the block diagram of FIG. 5. In the example of FIG. 5, the music tuner includes the microphone 27, the piezo device 37, a mic/piezo selection switch 35, an amplifier 36, a CPU, and a display 33. In FIG. 5, the CPU includes a pulse edge detection unit 51, a timer 53, a timer data transfer 55, a RAM (random access memory) 57, a mic/piezo selection control unit 61, a piezo level detection unit 63, data transfer 65, a buffer RAM 67, a fundamental frequency extraction unit 69, and a note/pitch error calculation unit 71.

The microphone 27 and the piezo device 37 are provided at the input of the music tuner to pick the sound of the music instrument. As noted above, the microphone 27 picks the sound of the music instrument through the air. The piezo device 37 picks the mechanical vibration (sound) from the music instrument and converts it into an electric signal. Outputs of the microphone 27 and the piezo device 37 are connected to the mic/piezo selection switch 35 which selects either one of the sensing device in response to a control signal from the mic/piezo selection control unit 63 in the CPU. The music sound selected by the mic/piezo selection switch 35 is amplified by the amplifier 36. The amplifier 36 has a high gain so that the sound wave is converted to square waves and is supplied to the pulse edge detection unit 51 in the CPU.

The output level of the piezo device 37 is monitored by the piezo level detection unit 63. If the piezo level is higher than a predetermined level, the piezo level detection unit 63 sends a signal to the mic/piezo selection control unit 61 to select the output from the piezo device 37 by the mic/piezo selection switch 35. Thus, the output signal from the piezo device 37 is used to measure the pitch of an instrument even when there is a sufficient signal level from the microphone 27. If the output level of the piezo device 37 is lower than the predetermined value, the output signal from the piezo will not be used.

The square waves from the amplifier 37 cross the zero volt level, edges (zero-crossing points) of the square waves are detected by the wave edge detection unit 51. The timer 53 measures the time period between two edges of the square waves. Because there are many zero cross points detected by the wave edge detection unit 51, the timer 53 produces a relatively large volume of time period data (zero-cross time data) which are consecutively sent to the RAM 57 through the timer data transfer 55. The RAM 57 stores the zero-cross time data from the timer 53, and when sufficient amount of data is collected, the zero-cross time data are sent to the buffer RAM 67 through the data transfer 65.

Since the music sound of the music instrument includes many frequency components other than the fundamental frequency, sufficient amount of zero-cross time data is needed to determine the fundamental frequency. The fundamental frequency extraction unit 69 performs self-correction on the zero-cross time data in the buffer RAM 67 to determine the fundamental frequency of the sound. The music tuner stores standard notes, for example, twelve temperament notes per octave, as target sounds to be compared with the extracted fundamental frequency. The note/pitch error calculation unit 71 determines a standard note closest to the fundamental frequency as a target sound and calculates the difference (pitch error) from the target sound. The music tuner displays the difference on the display screen 33.

Figure 6:
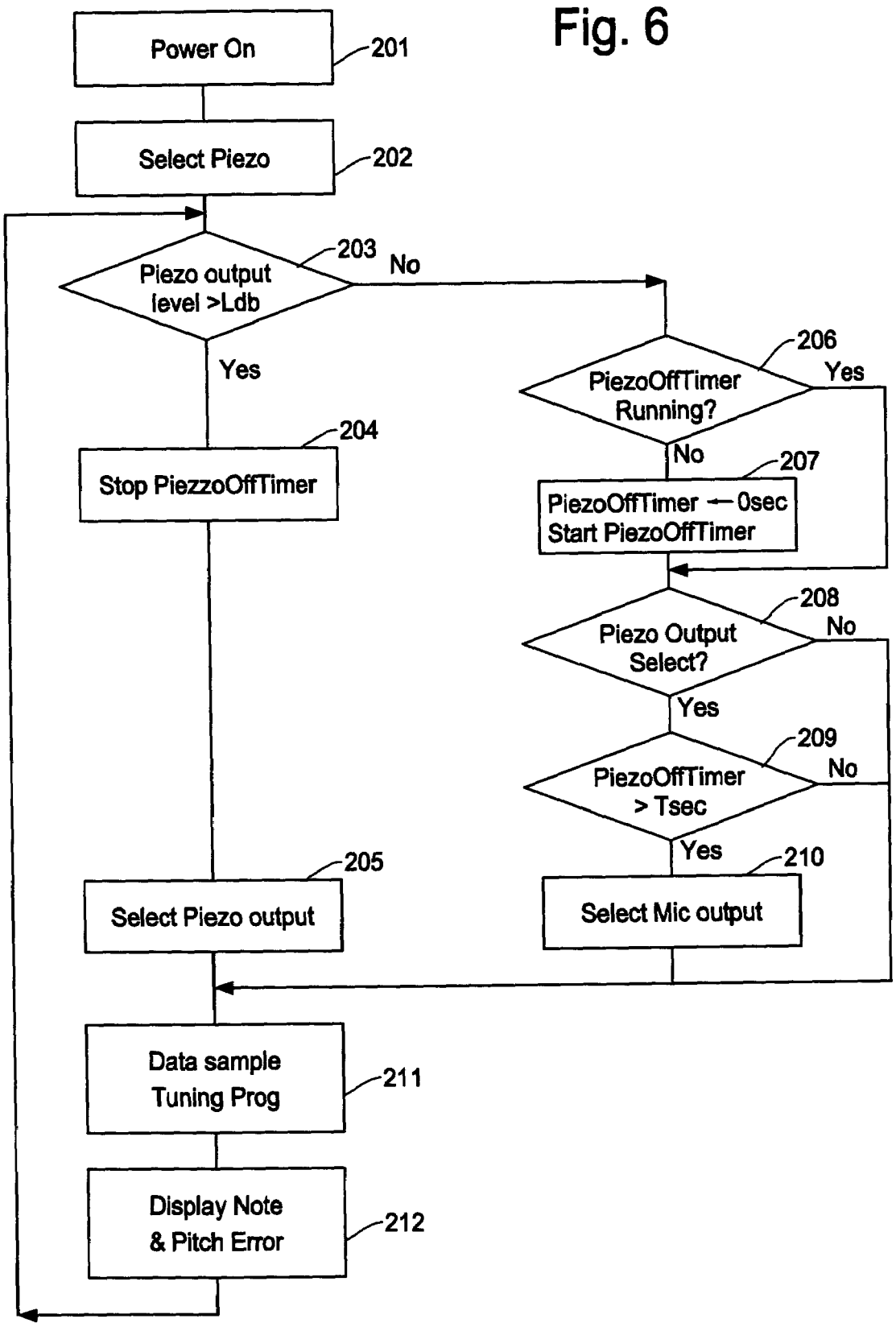
FIG. 6 is a flow chart showing the detailed algorithm for determining which sensing device, the microphone or the piezo device, should be selected by the music tuner of the present invention.

FIG. 6 shows the detailed algorithm for determining which music sensing device, i.e., the microphone or the piezo device, should be selected by the music tuner of the present invention. In this algorithm, the music tuner selects the piezo device 37 when the output signal level of the piezo device 37 is larger than the predetermined level. When the output signal level of the piezo device 37 is smaller than the predetermined level, the music tuner selects the microphone 27 only when the output level of the piezo device 37 remains smaller than the predetermined level longer than a predetermined time length.

In the flow chart of FIG. 6, the user turns on the music tuner to tune a music instrument in step 201. In default, the music tuner selects the piezo device 37 as a music sound sensing device. Thus, in step 202, the piezo device 37 is selected to pick the sound of the music instrument. At step 203, the music tuner determines whether the piezo output level is higher than a predetermined threshold level L db. It is also possible that the music tuner allows the user to set this threshold level.

In the case where the output level of the piezo device 37 exceeds the threshold level, the music tuner proceeds to step 204 where a "PiezoOffTimer" is stopped. The PiezoOffTimer is a timer which measures a time length from the point when the piezo output level became smaller than the threshold level to the point when the piezo output level exceeds the threshold level. In other words, the PiezoOffTimer starts to run when the output level from the piezo device is less than the threshold level and continues to run until the output of piezo device exceeds the threshold level. In other words, as will be explained in detail, the PiezoOffTimer is to prioritize the piezo device 37 in the music tuner. Since the piezo output level is higher than the threshold level, the PiezoOffTimer is stopped at step 204, and the music tuner selects the piezo device 37 as the sensing device in step 205.

Then, the process moves to steps 211 and 212 where the music sound through the piezo device 37 is processed for the data sampling, fundamental frequency extraction, and error pitch display. The process of steps 211 and 212 corresponds to the operation described in the foregoing with reference to the block diagram of FIG. 5. Based on the tuning error shown on the display, the user tunes her music instrument. Thus, the music tuner returns to the step 203 to repeat the foregoing steps.

In step 203, in the situation where the output level of the piezo device 37 is lower than the threshold level L db, the process moves to step 206 to check whether the PiezoOffTimer is running. If the PiezoOffTimer is not running, the music tuner activates the PiezoOffTimer in step 207, which starts counting a time length during which the piezo output level is lower than the threshold level. In the case where the PiezoOffTimer is already running, the music tuner skips the process of step 207 and goes directly to step 208.

In step 208, the music tuner determines whether the output of the piezo device 37 is already selected. If the piezo device 37 is not selected, it means that the output of the microphone 27 is already selected. Thus, the music tuner skips the process of steps 209 and 210 and goes directly to the steps 211 and 212 described above without any changes.

If the output of the piezo device 37 has been selected, at step 209, the music tuner determines whether a time length measured by the PiezoOffTimer's is longer than a predetermined time period T.

For example, the predetermined time period T is one (1) second. If the PiezoOffTimer's value is smaller than the predetermined time period T, this means that the output signal level of the piezo device 37 becomes larger than the threshold level within one (1) second. Then, the music tuner concludes that the output signal from the piezo device 37 should be used. Accordingly, the process moves directly to steps 211 and 212 without making any changes. Thus, the music tuner measures the output signal of the piezo device 37 in the same way after the step 205 noted above and returns to the step 203 for the next tuning.

However, if the PiezoOffTimer's value is longer than the predetermine time period T, one (1) second in the above example, the music tuner concludes that the output signal from the piezo device has been too weak for longer than the reasonable time length. As a result, the music tuner selects the output of the microphone 27 in step 210 to pick the music sound from the music instrument. The above noted steps are repeated, if necessary, for the other sounds of the musical instrument. In the preferred embodiment, the predetermined time period is about one (1) second as noted above, although other time length is also feasible.

Figure 7:
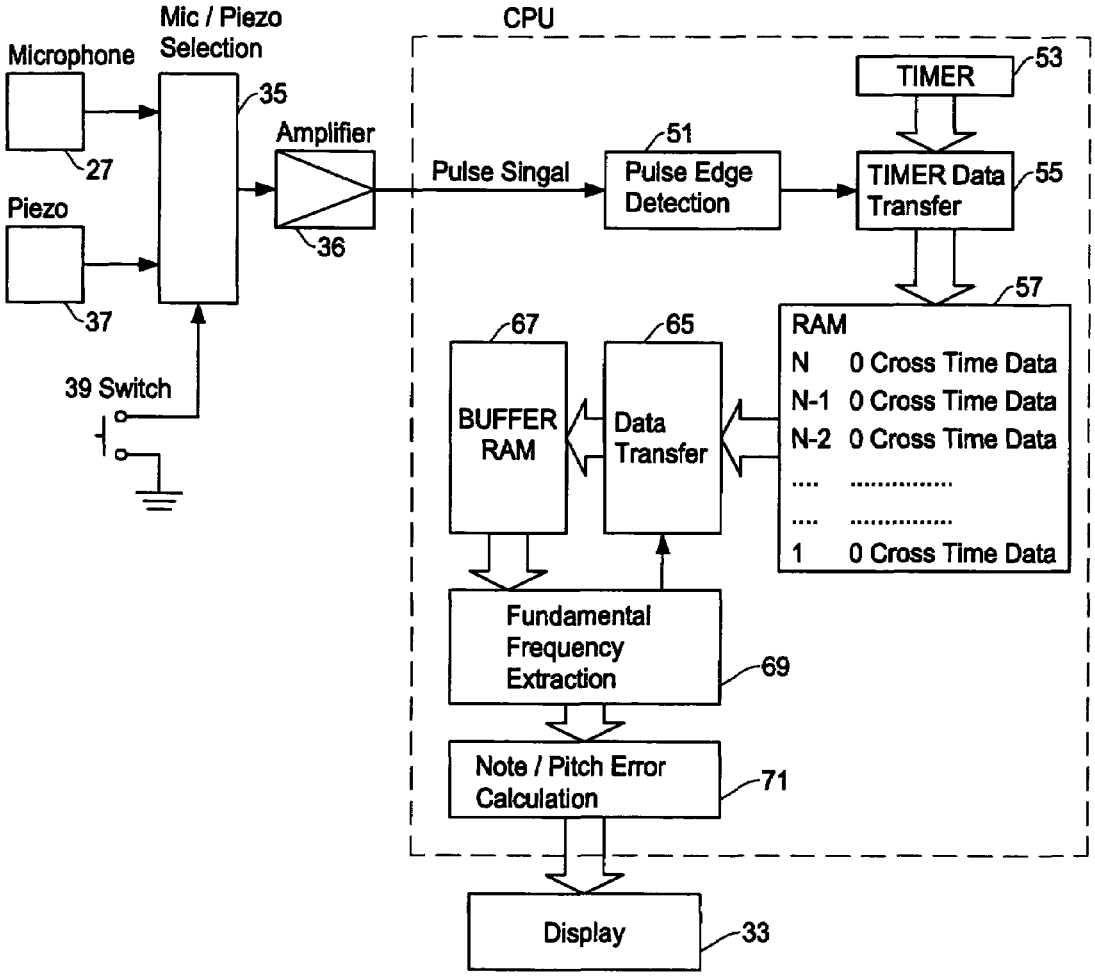
FIG. 7 is a schematic diagram showing the basic configuration of the internal structure of the music tuner of the present invention for manually selecting a sensing device and measuring the frequency of the sound.

As noted above with reference to FIG. 1C, the music tuner of the present invention also provides the switch 113 to manually change the sensing device. Therefore, the user can freely change the sensing device by pressing the manual switch 13. FIG. 7 is a block diagram showing the configuration of the music tuner in the manual mode where a switch 39 is provided to select the music sensing device. The switch 39 corresponds to the switch 113 of FIG. 1C and controls the mic/piezo selection switch 35. Other components in FIG. 7 are the same as those in FIG. 5, thus, explanation for which are omitted.

Another aspect of the present invention is a rotatable and detachable tuner body with a display screen to show the pitch of the sound from a music instrument. FIGS. 8A-8B, 9A–9B, 10A–10C and 11A–11B show this aspect of the present invention. In some cases, depending on how the music tuner is attached to a music instrument, a music stand, or a instrument case, etc., there arises a difficulty in viewing the display because the location to which the music tuner is attached does not always allow an optimum angle for viewing the display. The music tuner of the present invention has overcome this problem by the configuration in which the tuner body 23 is rotatable about a connection plug 43 as well as pivotable about a hinge 31*a* of a hinge portion 31 of the attachment clip 25.

Figure 8A:
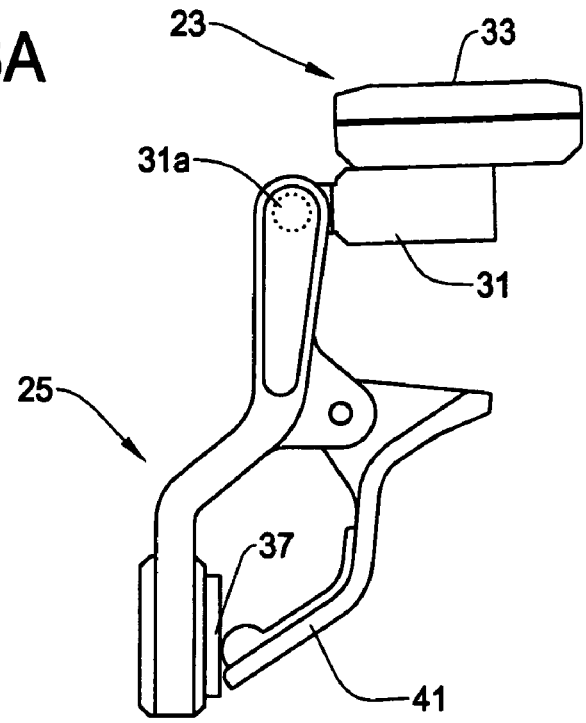
FIGS. 8A–8B are illustrations showing the music tuner of the present invention where the tuner body having a display is pivoted backwardly about a hinge portion where tuner body is pivoted in a large degree in FIG. 8A and in a small degree in FIG. 8B.
Figure 8B:
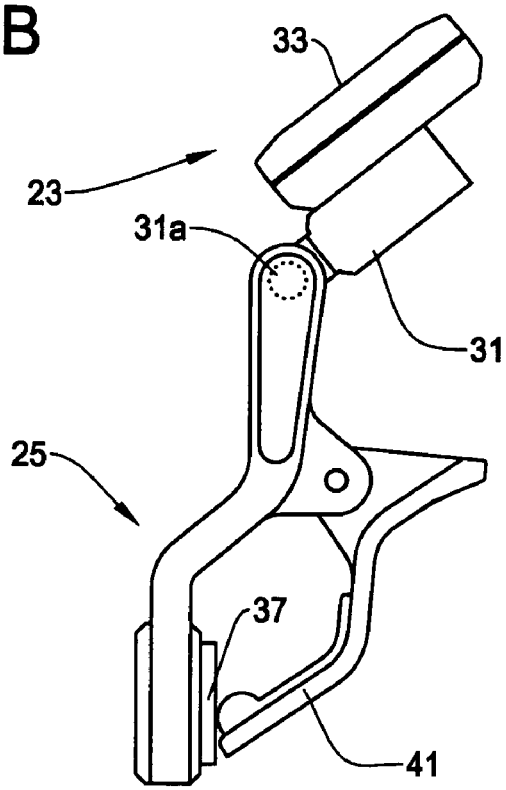
Figure 9A:
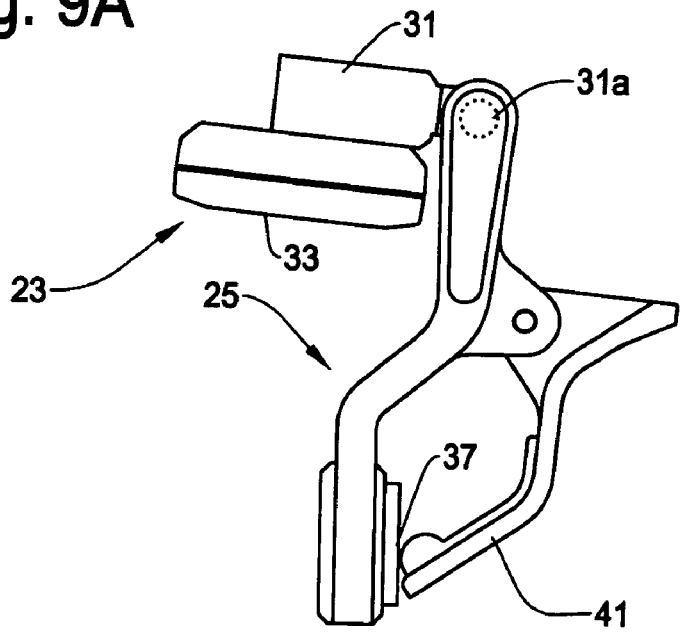
FIGS. 9A–9B are illustrations showing the music tuner of the present invention where the tuner body having a display is pivoted forwardly about a hinge portion where tuner body is pivoted in a large degree in FIG. 9A and in a small degree in FIG. 9B.
Figure 9B:
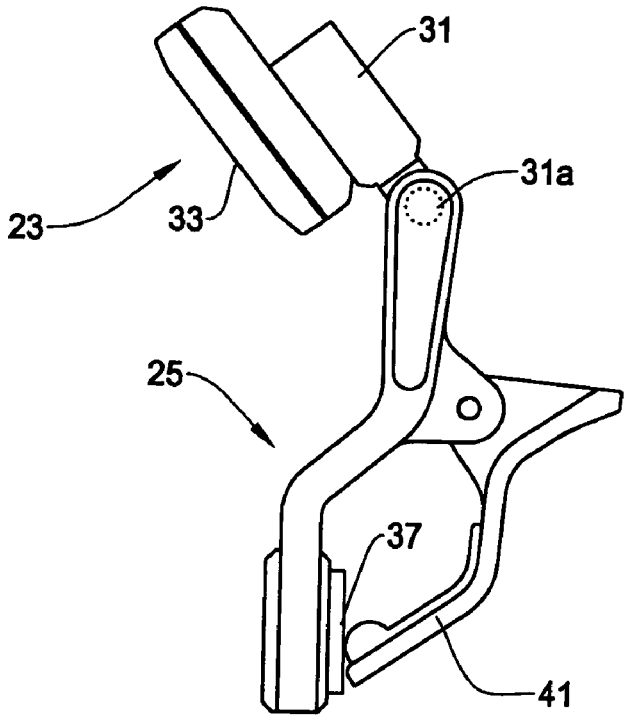

The operation of the hinge portion 31 is explained with reference to FIGS. 8A–8B and 9A–9B which show the side views of the music tuner of the present invention. Because the tuner body is attached to the hinge portion 31 which is pivotable about the hinge 31*a*, the tuner body 23 can pivot forwardly or backwardly so that the angle of the display screen 33 can be changed accordingly. FIG. 8A shows the condition where the tuner body 23 is pivoted backwardly in a large degree. FIG. 8B shows the condition where the tuner body 23 is pivoted backwardly in a small degree. FIG. 9A shows the condition where the tuner body 23 is pivoted forwardly in a large degree. FIG. 9B shows the condition where the tuner body 23 is pivoted forwardly in a small degree. The flexibility of the tuner body 23 allows the user to see the display 33 in an optimum angle.

Figure 10A:
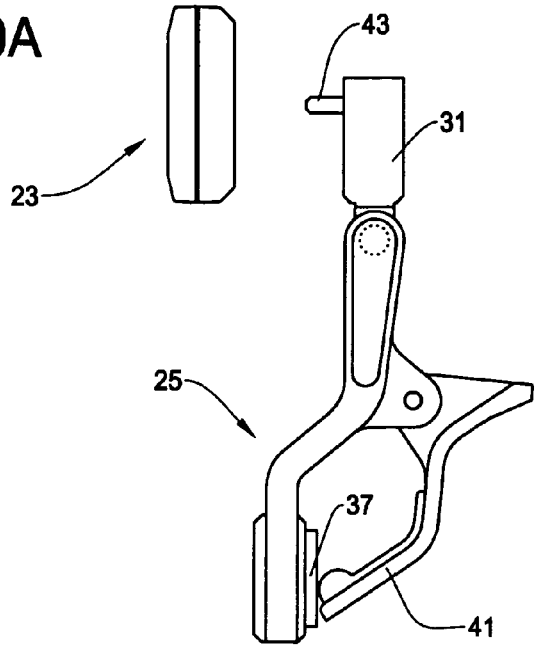
FIG. 10A is a schematic diagram showing the music tuner of the present invention where the tuner body is detached from the attachment clip.

Further, the tuner body 23 is rotatably and detachably connected to the attachment clip 25 through a connection plug 43. This configuration is explained with reference to FIGS. 10A–10C and 11A–11B. FIG. 10A is a side view of the music tuner of the present invention which shows the detached tuner body 23 and the attachment clip 25. The upper portion of the hinge portion 31 has a connection plug 43 to mechanically and electronically connect the tuner body 23 to the attachment clip 25.

Figure 10B:
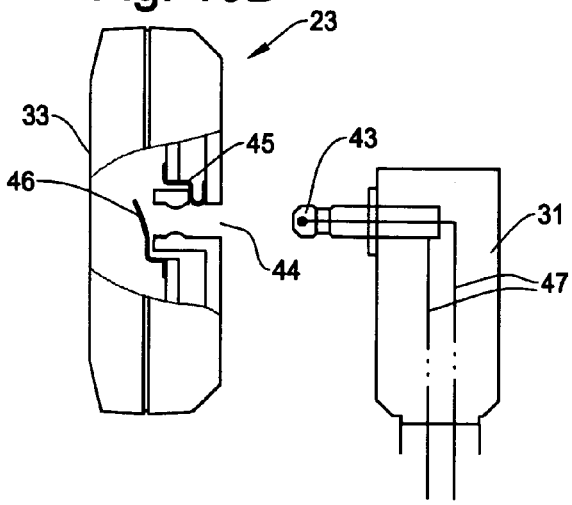
FIGS. 10B–10C are partial cross sectional views showing the structure of the music tuner for connecting or disconnecting the tuner body from the attachment clip.
Figure 10C:
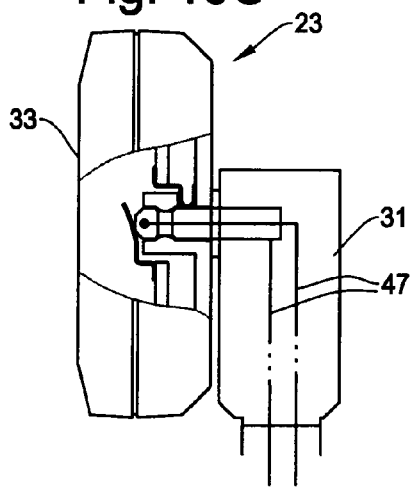

FIG. 10B is a partial cross sectional side view which shows the structural relationship between the tuner body 23 and the connection plug 43. A receptacle 44 is formed on the tuner body 23 to receive the connection plug 43 there through. Leads 45 and 46 are mounted on the receptacle 44 to establish electrical communication with the piezo device 37 at the end of the attachment clip 25 through signal lines 47 when the connection plug 43 is inserted in the receptacle 44. FIG. 10C is a cross sectional view which shows the condition where the tuner body 23 is attached to the attachment clip 25. The connection plug 43 contacts with the leads 45 and 46, thereby creating the signal path between the piezo device 37 and the tuner body 23.

Figure 11A:
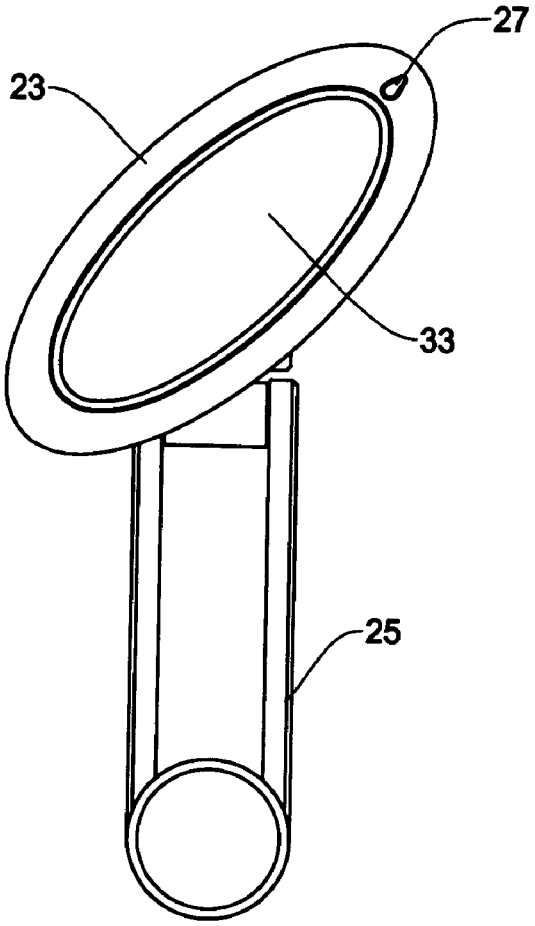
FIGS. 11A–11B are front views of the music tuner of the present invention where the tuner body attached to the attachment clip is rotated about the connection plug shown in FIGS. 10A–10C where the tuner body is inclined about 135 degrees in FIG. 11A, and the tuner body is rotated so that the display screen is oriented in a vertical direction in FIG. 11B.
Figure 11B:
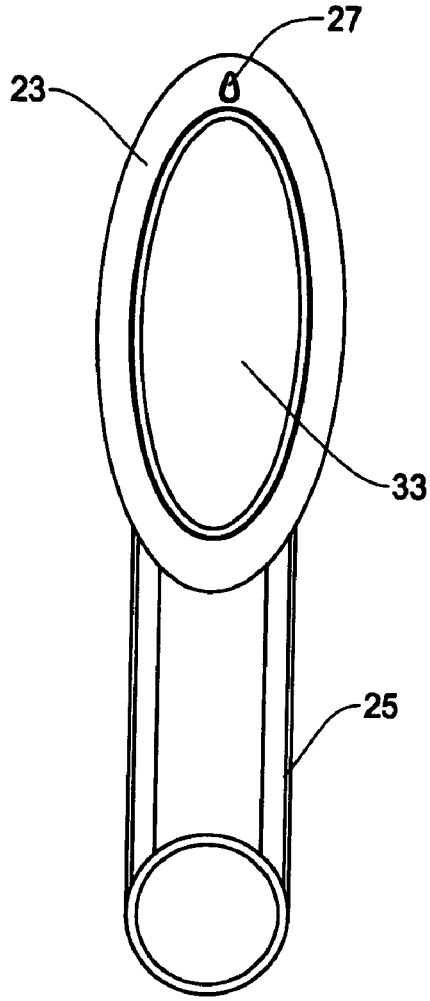

In the configuration of the music tuner shown in FIGS. 10A-10C, the tuner body 23 (display screen 33) can rotate about the connection plug 43 while maintaining the mechanical and electrical connection between the tuner body 23 and the attachment clip 25. The rotational movement of the tuner body 23 of the present invention is illustrated in FIGS. 11A and 11B. FIG. 11A shows the situation where the tuner body 23 (display screen 33) is rotated about 135 degrees clockwise from the condition of FIG. 1A. FIG. 11B shows a situation where the tuner body 23 is rotated about 90 degrees clockwise from the condition of FIG. 1A. As will be described in detail later, the arrangement of the tuner body 23 in the condition in FIG. 11B can also be advantageous if combined with the mirror display function of the present invention.

As in the foregoing, the tuner body 23 is pivotable in the backward and forward directions as well as rotatable in the clockwise and counterclockwise directions. Thus, the music tuner of the present invention allows the user to adjust the display so that the user can attain an optimum viewing angle when attaching the music tuner to a music instrument, a music stand, etc. Moreover, the user can read the display such that the lower pitch corresponds to the left of the display and the higher pitch corresponds to the right of the display whatever manner the music tuner is attached. Thus, the music tuner of the present invention allows the user a high flexibility and freedom.

A further aspect of the present invention is directed to display methods on the display screen 33 which will be described with reference to FIGS. 12A–12B, 13A–13B, 14A–14D and 15A–15D. FIGS. 12A–12B show examples of normal display mode and mirror display mode of the music tuner of the present invention where a display screen uses circular dots as a pitch indicator. This display screen is typically established by LED (light emitting diode). FIGS. 13A–13B show examples of normal display mode and mirror display mode of the music tuner of the present invention where a display screen uses moving bars as a pitch indicator. This display screen is typically established by LCD (liquid crystal display) panel.

FIGS. 12A(1)–12A(4) show the process and appearance of the display in a normal display mode when the music sound rises from the lower pitch to the higher pitch. More specifically, the indication at the center marked "0 CENT" means that the sound from the music instrument matches a target note (target sound). The highlighted dot on the left means that the sound from the music instrument is lower in pitch than the target note. The highlighted dot on the right means that the sound from the music instrument is higher in pitch than the target note.

Thus, FIG. 12A(1) shows that the sound from the instrument is lower than the target note. As the user raises the pitch of the sound, the highlighted dot moves toward the center as indicated in FIG. 12A(2). FIG. 12A(3) shows that the sound from the music instrument matches the target note. If the user still raises the pitch of the music instrument, the highlighted dot moves toward the right as shown in FIG. 12A(4), indicating that the sound from the music instrument is higher in pitch than the target sound.

When the highlighted dot is on the left side than the center, the user will normally attempt to raise the pitch. On the other hand, when the highlighted dot is on the right side than the center, the user will normally attempt to lower the pitch. Although not shown in the drawings, the target note such as B, C, or A# is normally indicated on the display in an actual implementation.

FIGS. 12B(1)–12B(4) show an example of the mirror display mode by the music tuner of the present invention. The mirror display mode is provided in the music tuner to allow the user to view the screen from an opposite or reverse direction and still obtain intuitive measurement results. In the mirror display mode, the display where the indicator's relationship to the sound pitch is reversed as compared with the normal display mode.

As the music sound reaches the desired target note, the dot indication moves toward the center. Unlike the normal display mode, in the mirror display mode, the highlighted dot located at the left as in FIG. 12B(4) means that the sound is higher than the target note, and the highlighted dot at the right as shown in FIGS. 12B(l) and 12B(2) means that the sound is lower than the target note. FIG. 12B(3) shows that the sound from the music instrument matches the target note. Thus, when the highlighted dot is on the left side than the center, the user will normally attempt to lower the pitch. On the other hand, when the highlighted dot is on the right side than the center, the user will normally attempt to raise the pitch.

FIGS. 13A–13B show another example of the tuner display that uses moving bars as an indicator to show the frequency of the sound. FIGS. 13A(1)–13A(4) show the process and appearance of the display in the normal display mode when the music sound rises from the lower pitch to the higher pitch. The highlighted bar at the center marked "0 CENT" means that the sound from the music instrument matches the target note. The highlighted bar on the left means that the sound from the music instrument is lower in pitch than the target note. The highlighted bar on the right means that the sound from the music instrument is higher in pitch than the target note.

Thus, FIG. 13A(1) shows that the sound from the instrument is lower than the target note. As the user raises the pitch of the sound, the highlighted bar moves toward the center as shown in FIG. 13A(2). FIG. 13A(3) shows that the sound from the music instrument matches the desired target note. If the user still raises the pitch of the music instrument, the highlighted bar moves toward the right as shown in FIG. 13A(4), indicating that the sound from the music instrument is higher than the target sound.

FIGS. 13B(1)–13B(4) show an example of the mirror display mode using the moving bar in the music tuner of the present invention. The highlighted bar in the right in FIG. 13B(1) shows that the sound from the instrument is lower than the target note. As the user raises the pitch of the sound, the highlighted bar moves toward the center as shown in FIG. 13B(2). FIG. 13B(3) shows that the sound from the music instrument matches the desired target note. If the user still raises the pitch of the music instrument, the highlighted bar moves toward the left as shown in FIG. 13B(4), indicating that the sound from the music instrument is higher in pitch than the target sound.

The mirror display function is useful when the display cannot be positioned in a normal angle. For example, in the case where the user has to place the tuner in such a way that the user has to see the display from an opposite direction, it is confusing for the user to interpret the display because the user is used to see the normal display mode. In such a case, the mirror display allows the user to see the display that is substantially the same as the normal display mode that is familiar to the user. Accordingly, the user can grasp the pitch on the display intuitively.

FIGS. 14A–14D show another example of mirror display mode in the music tuner of the present invention. The mirror display mode is also effective when the display screen is rotated by 90 degrees to allow the user to see the sound pitch by a vertical movement of the indicator. This display is intuitive because the sound of low frequency is illustrated at the lower position of the display screen and the sound of high frequency is illustrated at the higher position of the display screen. The indication at the center marked "0 CENT" means that the sound from the music instrument matches the target note.

Figure 14A:
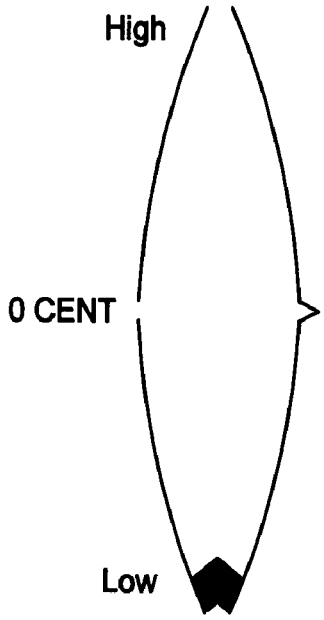
FIGS. 14A–14D are diagrams showing the display of the music tuner of the present invention during the process of tuning the sound from the music instrument when the display is rotated as shown in FIG. 11B.
Figure 14B:
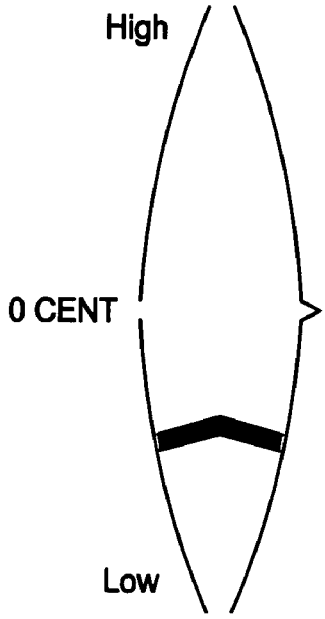
Figure 14C:
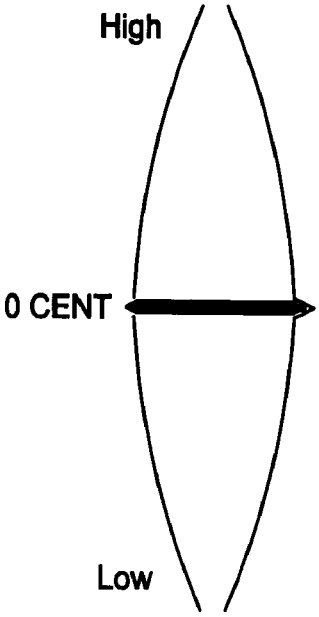
Figure 14D:
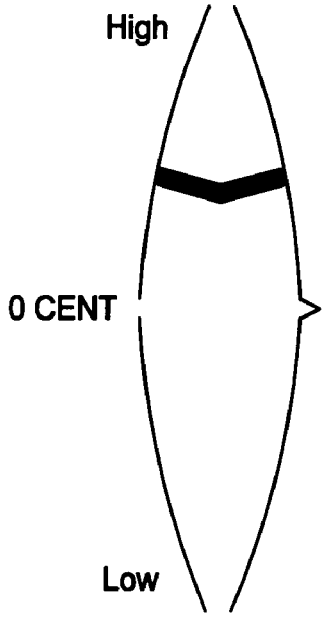

Thus, FIG. 14A shows that the sound from the instrument is lower than the target note. As the user raises the pitch of the sound, the highlighted bar moves up toward the center as shown in FIG. 14B. The situation of FIG. 14C shows that the sound from the music instrument matches the desired target note. If the user still raises the pitch of the music instrument, the highlighted bar moves up as shown in FIG. 14D, indicating that the sound from the music instrument is higher than the target sound.

In the example of FIGS. 15A–15D, the normal display mode and the mirror display mode can be operated simultaneously on the same display screen so that the two indicators (ex. dots or bars) at both edges are arranged to meet at the center to indicate that the music instrument is tuned up. This function is useful when it is difficult to see the display due to the darkness of the environment or too much reflective light in the environment. More particularly, if the LEDs are used for the display, it is sometimes difficult to see the LED's light in a well-lighted environment. In such a case, having two indicators helps the user to recognize the indicator. Further, this function is useful because the user does not have to think about whether the particular sound is higher or lower than the target sound but only to check whether the sound of her instrument is moving toward the target sound.

Figure 15A:
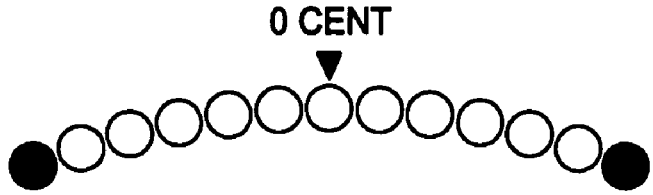
FIGS. 15A–15D are diagrams showing the display of the music tuner of the present invention which operates both the normal display mode the mirror display mode simultaneously during the process of tuning the sound from the music instrument.
Figure 15B:
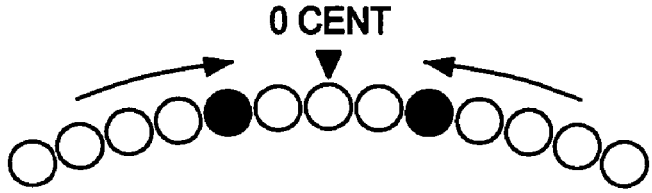
Figure 15C:
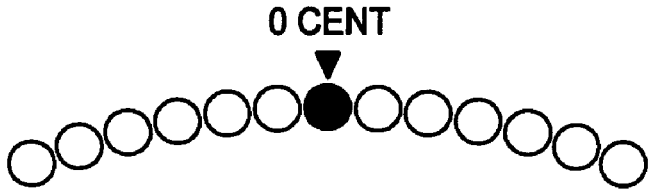
Figure 15D:
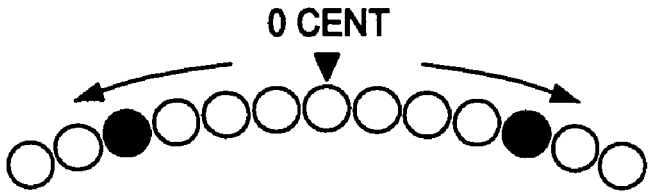

FIG. 15A shows that the sound is out of tune since the dots are highlighted at both ends. As the user changes the tune of the sound in response to the display indication, the highlighted dots move to the center as shown in FIG. 15B. Each highlighted dot comes close to each other toward the center if the sound comes closer to the target sound. FIG. 15C shows that the sound of the music instrument matches the target sound. When the user further raises the tune of the music instrument, each highlighted bar moves away from each other as shown in FIG. 15D.

As has been foregoing, because the music tuner of the present invention can automatically select the appropriate sound sensing device, the user need not worry about which sensing device to select. The user merely needs to attach the tuner to the music instrument. Because the tuner body is pivotable and rotatable, the user can enjoy an optimum viewing angle and condition. The mirror display function allows the user to obtain intuitive display image even when the specific circumstance forces the user to attach the tuner that would otherwise show the indicator in a reverse direction, etc.

Although the present invention is described herein with reference to the preferred embodiment, one skilled in the art will readily appreciate that various modifications and variations may be made without departing from the spirit and scope of the present invention. Such modifications and variations are considered to be within the purview and scope of the appended claims and their equivalents.

What is claimed is:

1. A music tuner for tuning a music instrument, comprising:

a tuner body having a display screen to show a pitch of a sound from the music instrument and a difference from a target sound;

a non-contact sensing device that senses sounds from said music instrument through the air, said non-contact sensing device being a microphone;

a contact sensing device that senses sounds from the music instrument by physically contacting with the music instrument, said contact sensing device being a piezoelectric device;

an attachment clip for attaching the music tuner to an object including the music instrument; and a circuitry to select either said non-contact sensing device or said contact sensing device for processing the sounds from the music instrument;

wherein said non-contact sensing device is mounted on the tuner body and said contact sensing device is mounted on the attachment clip, and wherein said tuner body is detachably connected to the attachment clip, thereby establishing the music tuner having both said non-contact sensing device and said contact sensing device one of which is automatically selected when tuning the music instrument.

2. A music tuner for tuning a music instrument as defined in claim 1, wherein said circuitry automatically selects either said non-contact sensing device or said contact sensing device by comparing an output level of the sensing device with a predetermined threshold level.

3. A music tuner for tuning a music instrument as defined in claim 1, wherein said circuitry selects either said non-contact sensing device or said contact sensing device in response to a manual operation of a switch provided on the music tuner.

4. A music tuner for tuning a music instrument as defined in claim 1, wherein said attachment clip having said contact sensing device is detachable from said tuner body to allow said music tuner to function separately and independently from said attachment clip.

5. A music tuner for tuning a music instrument as defined in claim 2, wherein said circuitry selects the contact sensing device for picking the sound of the music instrument when an output level of said contact sensing device is larger than the predetermined threshold level.

6. A music tuner for tuning a music instrument as defined in claim 2, wherein said circuitry selects the contact sensing device for picking the sound of the music instrument when an output level of said contact sensing device is larger than the predetermined threshold level, and wherein said circuitry determines whether a predetermined time has passed after the output level of said contact sensing device fell below said predetermined threshold level and selects said non-contact sensing device only if said predetermined time has passed.

7. A music tuner for tuning a music instrument as defined in claim 1, wherein said circuitry collects time period data of the sound of the music instrument detected by said sensing device, determines a fundamental frequency of the sound based on the collected time period data, and causes to display a difference between the fundamental frequency of the sound and a target sound.

8. A music tuner for tuning a music instrument as defined in claim 1, wherein said tuner body is attached to said attachment clip in a manner rotatable in clockwise and counterclockwise directions, and wherein said tuner body is attached to said attachment clip in a manner pivotable in backward and forward directions.

9. A music tuner for tuning a music instrument as defined in claim 1, wherein said display screen displays a measured result of the sound from the music instrument either by a normal display mode or a mirror display mode, wherein a lower frequency is displayed at a left side of the display screen and a higher frequency is displayed at a right side of the display screen in said normal display mode, while the lower frequency is displayed at the right side of the display screen and the higher frequency is displayed at the left side of the display screen in said mirror display mode.

10. A music tuner for tuning a music instrument as defined in claim 9, wherein said display screen displays a measured result of the sound from the music instrument both by said normal display mode and said mirror display mode at the same time.

11. A music tuner for tuning a music instrument as defined in claim 1, further comprising a connection plug provided at said attachment clip, wherein said connection plug establishes a mechanical and electrical connection to said tuner body so that said tuner body is detachable from said connection plug.

12. A music tuner for tuning a music instrument as defined in claim 11, wherein said tuner body rotates about said connection plug.

13. A method of tuning a music instrument by a music tuner having a non-contact sensing device and a contact sensing device to detect a sound from the music instrument, comprising following the steps of:

comparing a signal level from the contact sensing device with a threshold level;

selecting the contact sensing device for measuring the sound of the music instrument when the signal level from the contact sensing device exceeds the threshold level, said contact sensing device sensing sounds from the music instrument by physically contacting with the music instrument, said contact sensing device being a piezoelectric device;

selecting the non-contact sensing device for measuring the sound of the music instrument when the signal level from the contact sensing device is smaller than the threshold level for a time longer than a predetermined time period ,said non-contact sensing device sensing sounds from said music instrument through the air, said non-contact sensing device being a microphone; and processing the sound of the music instrument from the selected sensing device to detect a fundamental frequency of the sound of the music instrument, and displaying a difference of pitch between the sound from the music instrument and a target sound.

14. A method of tuning a music instrument as defined in claim 13, wherein said step of selecting the non-contact sensing device includes a step of determining whether the predetermined time has passed after the output level of said contact sensing device fell below said predetermined threshold level and selecting said non-contact sensing device only if said predetermined time has passed.

15. A method of tuning a music instrument as defined in claim 13, wherein said step of displaying the difference of pitch includes a step of displaying a measured result of the sound from the music instrument either by a normal display mode or a mirror display mode, wherein a lower frequency is displayed at a left side of the display screen and a higher frequency is displayed at a right side of the display screen in said normal display mode, while the lower frequency is displayed at the right side of the display screen and the higher frequency is displayed at the left side of the display screen in said mirror display mode.

16. A method of tuning a music instrument as defined in claim 15, wherein said step of displaying the difference of pitch includes a step of displaying a measured result of the sound from the music instrument both by said normal display mode and said mirror display mode at the same time.

* * * * *